US010697653B2

(12) United States Patent
Bush et al.

(10) Patent No.: US 10,697,653 B2
(45) Date of Patent: Jun. 30, 2020

(54) AIR-CONDITIONING SYSTEM WITH AIR DISCHARGE BAFFLE

(71) Applicant: Mitsubishi Electric US, Inc., Cypress, CA (US)

(72) Inventors: Joseph Paul Bush, Lawrenceville, GA (US); Khurram Ali, Suwanee, GA (US); Peter Christian Flynn, Flowery Branch, GA (US)

(73) Assignee: Mitsubishi Electric US, Inc., Cypress, CA (US)

( * ) Notice: Subject to any disclaimer, the term of this patent is extended or adjusted under 35 U.S.C. 154(b) by 154 days.

(21) Appl. No.: 16/023,844

(22) Filed: Jun. 29, 2018

(65) Prior Publication Data

US 2020/0003435 A1 Jan. 2, 2020

(51) Int. Cl.

| | |
|---|---|
| ***F24F 1/48*** | (2011.01) |
| ***F24F 1/68*** | (2011.01) |
| ***F24F 13/08*** | (2006.01) |
| ***F24F 13/04*** | (2006.01) |
| ***F24F 13/06*** | (2006.01) |
| ***F24F 7/06*** | (2006.01) |

(52) U.S. Cl.

CPC ..... *F24F 1/48* (2013.01); *F24F 1/68* (2013.01); *F24F 7/06* (2013.01); *F24F 13/04* (2013.01); *F24F 13/06* (2013.01); *F24F 13/08* (2013.01)

(58) Field of Classification Search

CPC ..... F24F 1/48; F24F 7/06; F24F 13/06; F24F 13/04; F24F 13/08; F24F 1/68

See application file for complete search history.

(56) References Cited

U.S. PATENT DOCUMENTS

2015/0198339 A1* 7/2015 Jeon ..... F24F 1/48 62/259.2

FOREIGN PATENT DOCUMENTS

| | | | |
|---|---|---|---|
| CN | 106225106 | A | 12/2016 |
| KR | 200161702 | Y1 | 12/1999 |
| KR | 200371375 | Y1 | 12/2004 |
| KR | 20060118646 | A | 11/2006 |

* cited by examiner

*Primary Examiner* — Emmanuel E Duke

(74) *Attorney, Agent, or Firm* — Posz Law Group, PLC

(57) ABSTRACT

An air-conditioning system is provided, comprising: an air conditioner including a first fan having a first fan input configured to receive first input air, and a first fan output configured to generate a first output air stream in a horizontal direction, and a second fan having a second fan input configured to receive second input air, and a second fan output configured to generate a second output air stream in the horizontal direction; an air baffle including a first upflow duct attached to the air-conditioner and configured to direct the first output air stream into a first deflected air stream flowing in a first direction between 0 degrees and 45 degrees from vertical, and a second upflow duct attached to the air-conditioner and configured to direct the second output air stream into a second deflected air stream flowing in a second direction between 0 degrees and 45 degrees from vertical.

20 Claims, 6 Drawing Sheets

AIR-CONDITIONING SYSTEM WITH AIR DISCHARGE BAFFLE

FIELD OF THE INVENTION

The present invention relates generally to a system and method for deflecting horizontally output air from an air conditioner to a vertical or near vertical direction. More particularly, the present invention relates to a system and method in which a vertical discharge baffle is attached to an output side of an air conditioner to deflect the air output from the discharge side of the air conditioner so that it passes vertical or near-vertical in direction to avoid interference with nearby structures.

BACKGROUND OF THE INVENTION

Many conventional outdoor air-conditioning units include one or more fans that draw supply air in horizontally from one side, exchange heat with the supply air, and then discharge the modified air (heated or cooled) out horizontally at an opposite side. For example, a conventional heat pump (used as an air conditioner) operating to cool an inside space in a building would draw in air at an outside temperature horizontally at inputs of one or more fans, exchange heat with the supply air, thus raising the temperature of the air, and then discharge the heated air as output air horizontally at outputs of the one or more fans. Similarly, if the air conditioner were used to heat the inside space, the discharged output air would be cooler than the supply air.

In this way, the conventional air conditioner (e.g., heat pump) will have a steady stream of supply air coming in horizontally at one side, and a steady stream of output air passing out horizontally at the opposite side. Furthermore, there will be a temperature differential between the supply air and the output air, based on the mode that the air conditioner is operating in (heating or cooling).

One issue that arises with air conditioners having horizontal-facing fans is that the fans require a minimum distance between the output of the fans and any obstruction (e.g., a wall, shrubbery, etc.) This distance can be on the order of three or four feet, limiting the placement of the air conditioner and requiring a relatively large open space for its installation.

In some circumstances, it is desirable for a building or set of buildings to have multiple air conditioners set up to service them. In such circumstances an array of air conditioners is used to heat/cool the building or buildings. However, because of the clearance requirements for the air conditioners, the space required for this air-conditioning array can be relatively large. Furthermore, the clearance requirements can be significantly greater if the air output of one air conditioner faces the air input of another air conditioner.

Because a conventional air conditioner typically operates by exchanging heat with the supply air, it is important that the supply air for an air conditioner be at a temperature as close as possible to the desired inside temperature. For example, if the air conditioner is operating in a cooling mode, it is desirable to keep the supply air as cool as possible. Since the output air for an air conditioner has already been involved in a heat transfer, this means that the output air from one air conditioner is typically not well suited as supply air for another air conditioner.

As a result of this, a greater clearance is required between the air output of one air-conditioning unit and the air input of another air-conditioning unit. This distance can be on the order of ten feet, and can significantly limit the placement of multiple outdoor air conditioners and require very large spaces to provide an air conditioner array.

Furthermore, this often means that it is desirable to arrange air conditioners in an array such that they are not facing in the same direction (i.e., so that their air outputs do not face the air inputs of other air conditioners in the array). Since the air conditioners in the array are often the same type of device, this means that the air conditioners are often placed such that power and refrigerant inputs for the various air conditioners are arranged to face in different directions, which requires additional piping and cabling to provide the necessary connections to the air-conditioning devices.

It would therefore be desirable to provide a way in which the required clearance for air conditioners was reduced, allowing for a higher density of air conditioners in an air-conditioning array. It would also be desirable to provide a way in which air conditioners could be arranged in an array in the same orientation to allow for their power and refrigerant connections to all face in the same direction.

SUMMARY OF THE INVENTION

An air-conditioning system is provided, comprising: an air conditioner including a first fan having a first fan input on a first side of the air-conditioner configured to receive first input air, and a first fan output on a second side of the air-conditioner configured to generate a first output air stream in a horizontal direction with respect to a surface on which the air conditioner is placed, and a second fan having a second fan input on the first side of the air-conditioner configured to receive second input air, and a second fan output on the second side of the air-conditioner configured to generate a second output air stream in the horizontal direction; an air baffle including a first upflow duct attached to the second side of the air-conditioner and configured to direct the first output air stream into a first deflected air stream flowing in a first direction between 0 degrees and 45 degrees from vertical with respect to the surface, and a second upflow duct attached to the second side of the air-conditioner and configured to direct the second output air stream into a second deflected air stream flowing in a second direction between 0 degrees and 45 degrees from vertical with respect to the surface.

The first airflow duct and the second air flow duct may be configured such that the first deflected air stream and the second deflected air stream have substantially the same air flow.

The air conditioner may be a heat pump or an outdoor air-conditioning unit.

The second fan may be located above the first fan, and the second duct may be located inside the first duct. The second fan may instead be located beside the first fan.

The air baffle may further comprise a top-air diverter located above the first and second upflow ducts, and the top-air diverter may be configured to divert the first deflected air stream into a first angled air stream that flows at a first set angle from vertical, divert the second deflected air stream into a second angled air stream that flows at a second set angle from vertical, and limit at least one of precipitation and debris from passing into the first and second upflow ducts.

The first angled air stream and the second angled air stream may flow in different directions.

The first and second set angles may both be between 30 and 60 degrees.

The first upflow duct may further comprise a first outlet on a first bottom portion, the first outlet being configured to provide an outlet for at least one of precipitation and debris that passes into the first upflow duct.

The second upflow duct may further comprise a second outlet on a second bottom portion, the second outlet being configured to provide an outlet for at least one of precipitation and debris that passes into the second upflow duct.

The first and second deflected air streams may be substantially vertical with respect to the surface.

An air-conditioning array may be provided comprising: a plurality of the air-conditioning systems described above, wherein the plurality of air-conditioning systems are arranged in a row along a direction of the first and second horizontal air streams such that the first side of each of the plurality of air-conditioning systems faces the same direction.

A method of operating an air-conditioning system is provided, comprising: receiving first air at a first input of a first fan on a first side of an air conditioner; ejecting the first air at a first output of the first fan on a second side of the air conditioner as a first horizontal air stream flowing horizontal to a surface on which the air-conditioning system is placed; deflecting the first horizontal air stream to form a first deflected air stream flowing in a first direction between 0 degrees and 45 degrees from vertical with respect to the surface; receiving second air at a second input of a second fan on the first side of the air conditioner; ejecting the second air at a second output of the second fan on the second side of the air conditioner as a second horizontal air stream flowing horizontal to the surface; deflecting the second horizontal air stream to form a second deflected air stream flowing in a second direction between 0 degrees and 45 degrees from vertical with respect to the surface; wherein the first deflected air stream and the second deflected air stream are isolated from each other.

The first deflected air stream and the second deflected air stream may have substantially equal air flow.

The air conditioner may be a heat pump or an outdoor air-conditioning unit.

The second horizontal air stream may be located above the first horizontal air stream.

The method may further comprise diverting the first deflected air stream into a first angled air stream that flows at a first set angle from vertical with respect to the surface, diverting the second deflected air stream into a second angled air stream that flows at a second set angle from vertical with respect to the surface, and deflecting at least one of precipitation and debris from passing into the first and second deflected air streams.

The first angled air stream and the second angled air stream may flow in different directions.

The first and second set angles may both be between 30 and 60 degrees.

The method may further comprise: discharging at least one of precipitation and debris from interfering with either the first horizontal air flow or the first deflected air flow.

The method may further comprise discharging at least one of precipitation and debris from interfering with either the second horizontal air flow or the second deflected air flow.

The first and second deflected air streams may be substantially vertical.

An air-conditioning array is provided, comprising: a first air conditioner including a first fan configured to draw in first air from a first input surface of the first air conditioner and to generate a first horizontal air stream at a first output surface of the first air conditioner opposite the first input surface, a second fan configured to draw in second air from the first input surface and to generate a second horizontal air stream from the first output surface, a first air baffle affixed to the first output surface and configured to deflect the first horizontal air stream to generate a first deflected air stream flowing in a first direction between 0 degrees and 45 degrees from vertical and to deflect the second horizontal air stream to generate a second deflected air stream flowing in a second direction between 0 degrees and 45 degrees from vertical; a second air conditioner including a third fan configured to draw in third air from a second input surface of the second air conditioner and to generate a third horizontal air stream at a second output surface of the second air conditioner opposite the second input surface, a fourth fan configured to draw in fourth air from the second input surface and to generate a fourth horizontal air stream from the second output surface, a second air baffle affixed to the second output surface and configured to deflect the third horizontal air stream to generate a third deflected air stream flowing in a third direction between 0 degrees and 45 degrees from vertical and to deflect the fourth horizontal air stream to generate a fourth deflected air stream flowing in a fourth direction between 0 degrees and 45 degrees from vertical, wherein the first output surface is arranged to face the second input surface, and a distance between the first and second air conditioners is set to be less than 36 inches.

The air-conditioning array may further comprise: a third air conditioner including a fifth fan configured to draw in fifth air from a third input surface of the third air conditioner and to generate a fifth horizontal air stream at a third output surface of the third air conditioner opposite the third input surface, a sixth fan configured to draw in sixth air from the third input surface and to generate a sixth horizontal air stream from the third output surface, a third air baffle affixed to the third output surface and configured to deflect the fifth horizontal air stream to generate a fifth deflected air stream flowing in a fifth direction between 0 degrees and 45 degrees from vertical and to deflect the sixth horizontal air stream to generate a sixth deflected air stream flowing in a sixth direction between 0 degrees and 45 degrees from vertical, wherein the second output surface is arranged to face the third input surface, and a distance between the second and third air conditioners is set to be less than 36 inches.

The air-conditioning array may further comprise: a refrigerant pipe configured to carry a refrigerant, wherein the first air conditioner includes a first refrigerant connector on a first side surface, the second air conditioner includes a second refrigerant connector on a second side surface, the first and second side surfaces face in the same direction, the refrigerant pipe passes beside the first and second side surfaces, the refrigerant pipe is connected to the first refrigerant connector, and the refrigerant pipe is connected to the second refrigerant connector.

The air-conditioning array may further comprise: a power line configured to carry electric power, wherein the first air conditioner includes a first power connector on a first side surface, the second air conditioner includes a second power connector on a second side surface, the first and second side surfaces face in the same direction, the power line passes beside the first and second side surfaces, the power line is connected to the first power connector, and the power line is connected to the second power connector.

BRIEF DESCRIPTION OF THE DRAWINGS

The accompanying figures where like reference numerals refer to identical or functionally similar elements and which together with the detailed description below are incorporated in and form part of the specification, serve to further illustrate an exemplary embodiment and to explain various principles and advantages in accordance with the present disclosure.

DETAILED DESCRIPTION

The instant disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. It is noted that some embodiments may include a plurality of processes or steps, which can be performed in any order, unless expressly and necessarily limited to a particular order; i.e., processes or steps that are not so limited may be performed in any order.

Air-Conditioning System

Figure 1:
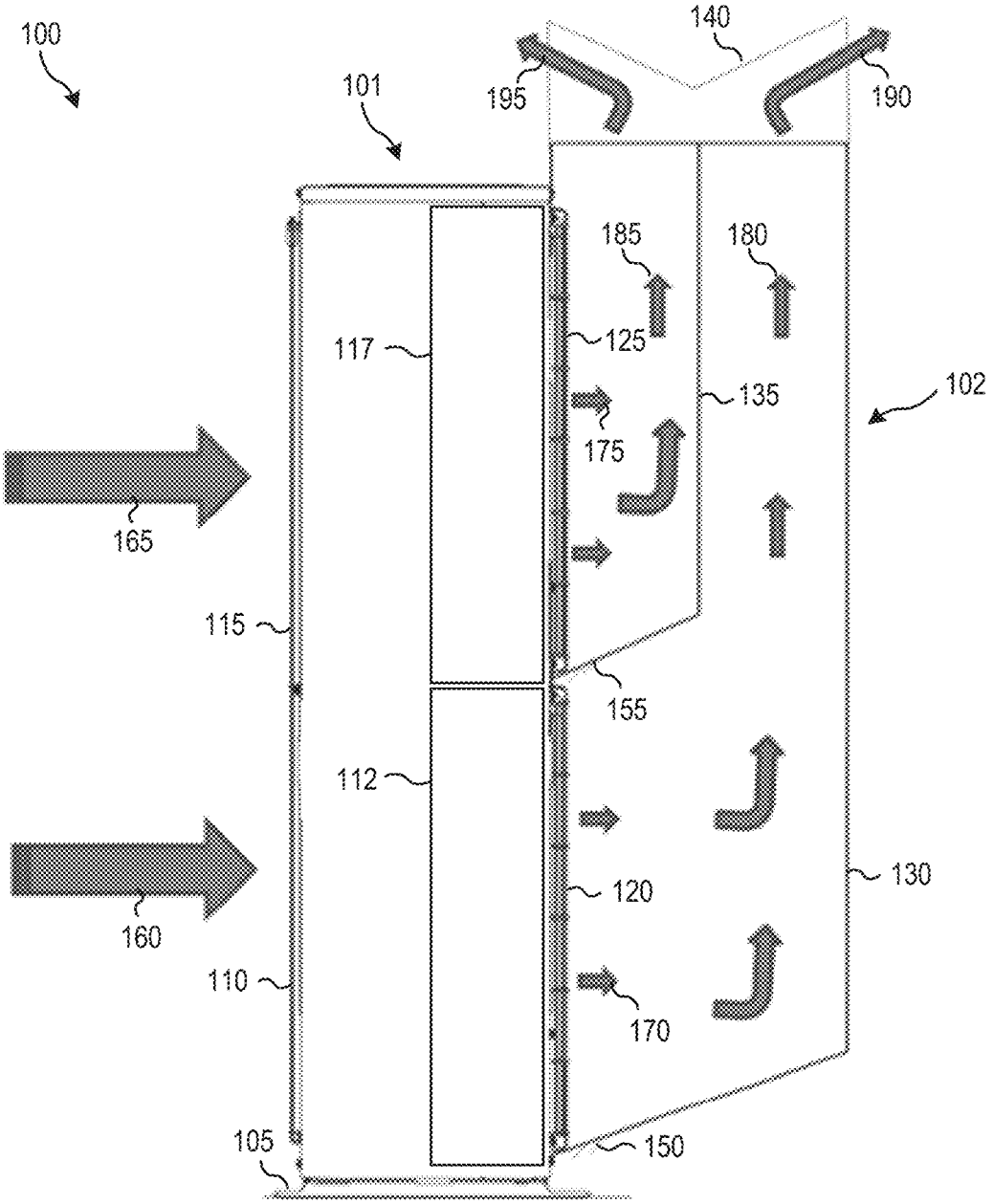
FIG. 1 is a cross-sectional view of an air-conditioning system according to disclosed embodiments.

FIG. 1 is a cross-sectional view of an air-conditioning system 100 according to disclosed embodiments. As shown in FIG. 1, the air-conditioning system 100 includes an air conditioner 101 and an air baffle 102. The air conditioner 101 includes first and second fans 112, 117, a plurality of installation feet 105, a first fan input 110, a second fan input 115, a first fan output 120, and a second fan output 125. The air baffle 102 includes a first upflow duct 130, a second upflow duct 135, a top-air diverter 140, a first outlet 150, and a second outlet 155.

The air conditioner 101 is an air-conditioning unit that exchanges heat between supply air received from outside the air conditioner 101 and refrigerant supplied to the air conditioner 101. This heat exchange is performed to treat the refrigerant such that it can be used to heat or cool an interior space in a building.

The installation feet 105 are provided at the bottom of the air conditioner 101, and serve as supports for the air conditioner 101. In some embodiments, the installation feet 105 can be secured to the surface on which the air conditioner 101 is formed.

Typically, the air conditioner 101 will be an outdoor air-conditioning unit in an air-conditioning system. In some embodiments the air conditioner 101 will be a heat pump or a condenser.

The air conditioner 101 includes first and second fans 112, 117 for drawing in the supply air. In the disclosed embodiment these fans 112, 117 are arranged vertically such that a second fan 117 is on top of a first fan 112. However, in alternate embodiments, the first and second fans 112, 117 can be arranged side-by-side.

The first fan input 110 is a portion of the first fan that draws in first input air 160 from the surrounding supply air. This first input air 160 is drawn in horizontally from an area beside the first fan input 110.

The second fan input 115 is a portion of the second fan that draws in second input air 165 from the surrounding supply air. This second input air 165 is drawn in horizontally from an area beside the second fan input 115.

The first fan output 120 is a portion of the first fan that produces a first output air stream 170 in a horizontal direction with respect to a surface on which the air conditioner 101 is placed. This first output air stream 170 is formed from the first input air 160 after the first input air 160 has exchange heat with refrigerant inside the air conditioner 101. As a result, the first output air stream 170 will typically be of a different temperature than the first input air 160. If the air conditioner 101 is performing a heating operation, the air temperature of the first output air stream 170 will be lower than the temperature of the first input air 160; and if the air conditioner 101 is performing a cooling operation, the air temperature of the first output air stream 170 will be higher than the temperature of the first input air 160.

The second fan output 125 is a portion of the second fan that produces a second output air stream 175 in a horizontal direction with respect to a surface on which the air conditioner 101 is placed. This second output air stream 175 is formed from the second input air 165 after the second input air 165 has exchange heat with refrigerant inside the air conditioner 101. As a result, the second output air stream 175 will typically be of a different temperature than the second input air 165. If the air conditioner 101 is performing a heating operation, the air temperature of the second output air stream 175 will be lower than the temperature of the second input air 165; and if the air conditioner 101 is performing a cooling operation, the air temperature of the second output air stream 175 will be higher than the temperature of the second input air 165.

The first upflow duct 130 is an air duct attached to the same side of the air conditioner 101 as the first and second fan outputs 120, 125. It operates to deflect air from flowing in a horizontal direction to flowing in a substantially vertical direction. In the embodiment of FIG. 1, the first upflow duct 130 is large enough that it covers the entirety of both the first and second fan outputs 120, 125.

The first upflow duct 130 in the disclosed embodiment includes a first lower slanted portion, a first side portion, and a first top opening to allow air to escape in a substantially vertical direction. Alternate embodiments can vary this design, provided it operates to deflect air from a horizontal direction to a substantially vertical direction, and allows the air to escape in a substantially vertical direction.

The second upflow duct 135 is an air duct attached to the same side of the air conditioner 101 as the first and second fan outputs 120, 125. The second upflow duct 135 operates to deflect air from flowing in a horizontal direction to flowing in a substantially vertical direction. In the embodiment of FIG. 1, the second upflow duct 135 is contained within the first upflow duct 130 and covers only the second fan output 125. Alternate embodiments can vary this design, however, so long as the second upflow duct 135 operates to deflect air passing in the horizontal direction to flowing in a substantially vertical direction.

The second upflow duct 135 in the disclosed embodiment includes a second lower slanted portion, a second side portion, and a second top opening to allow air to escape in a substantially vertical direction. Alternate embodiments can vary this design, provided it operates to deflect air from a horizontal direction to a substantially vertical direction, and allows the air to escape in a substantially vertical direction.

In operation, the disclosed first and second upflow ducts 130, 135 function as follows. The first output air stream 170 output from the first fan output 120 in a horizontal direction passes into the first upflow duct 130 where it is deflected into a first deflected air stream 180 passing in a substantially vertical direction. Similarly, the second output air stream 175 output from the second fan output 125 in a horizontal direction passes into the second upflow duct 135 where it is deflected into a second deflected air stream 185 passing in a substantially vertical direction.

In the disclosed embodiment, the first and second upflow ducts 130, 135 are designed such that the first deflected air stream 180 and the second deflected air stream 185 have substantially the same airflow. In other words, the first and second upflow ducts 130, 135 pass substantially the same quantity of air over a given time. This ensures that the first and second fans will operate on substantially the same flow rate of air. As a result, neither of the first and second fans will be subjected to greater stress than the other, and they can both operate at approximately the same efficiency.

Although in the disclosed embodiment of FIG. 1, the first and second upflow ducts 130, 135 are configured to deflect air into first and second deflected air streams 180, 185 passing in a substantially vertical direction, this is by way of example only. In alternate embodiments, the first and second upflow ducts 130, 135 can be arranged to deflect the first and second output air streams 170, 175 to form first and second deflected air streams 180, 185 flowing in any direction between 0° and 45° from vertical with respect to the surface on which the air conditioner 101 is placed. In such alternate embodiments, the first and second side portions of the first and second upflow ducts 130, 135 will be slanted as necessary to provide the desired degree of deflection for the first and second deflected air streams 180, 185.

Generally, the first and second upflow ducts 130, 135 will be configured to deflect the first and second output air streams 170, 175 into first and second deflected air streams 180, 185 that flow in the same direction. However, this is by way of example only. In alternate embodiments, the first and second deflected air streams 180, 185 can be deflected at different degrees of deflection from each other.

The top-air diverter 140 is formed over the first and second top openings of the first and second upflow ducts 130, 135. It serves the dual purpose of diverting the first and second deflected air streams 180, 185 into first and second angled air streams 190, 195, respectively, and protecting the first and second upflow ducts 130, 135 from receiving precipitation or debris.

It can be desirable to protect the first and second upflow ducts 130, 135 from receiving precipitation or debris, since such precipitation or debris can interfere with the first and second output air streams 170, 175 and the first and second deflected air streams 180, 185. For example, if snow or leaves get trapped in the first or second upflow ducts 130, 135, their presence can significantly impede the flow of the first and second output air streams 170, 175 and the first and second deflected air streams 180, 185, degrading the performance of the air conditioner 101.

The first and second angled air streams 190, 195 flow at first and second set angles from vertical, respectively. These angles can be the same, or different, as desired by the particular embodiment. The first and second deflected air streams 180, 185 are diverted to the first and second angled air streams 190, 195 by first and second angled top surfaces of the top-air diverter 140, respectively.

The first and second angled top surfaces of the top-air diverter 140 serve to catch or deflect precipitation and debris, thereby limit the precipitation or debris from being able to pass into the first and second upflow ducts 130, 135.

Although the top-air diverter 140 in the embodiment of FIG. 1 includes first and second angled top surfaces, this is by way of example only. Alternate embodiments could use any desired configuration for diverting the first and second deflected air streams 180, 185 into the first and second angled air streams 190, 195. In one alternate embodiment a single flat top surface could be used. Other possibilities can also be used. For example, the top-air diverter 140 could have a peaked rook above and an oppositely angled surface facing the first and second upflow ducts 130, 135.

The first outlet 150 is formed in the lower slanted portion of the first upflow duct 130, and serves as an opening to allow at least precipitation and debris that enters into the first upflow duct 130 to pass out of the first upflow duct 130. Typically, the first outlet 150 will be located at the lowest portion of the first upflow duct 130 where precipitation and debris would collect.

The second outlet 155 is formed in the lower slanted portion of the second upflow duct 135, and serves as an opening to allow at least precipitation and debris that enters into the second upflow duct 135 to pass out of the second upflow duct 135. Typically, the second outlet 155 will be located at the lowest portion of the second upflow duct 135 where precipitation and debris would collect.

The first and second outlets 150, 155 can be are provided because the operation of the top-air diverter 140 may not be 100% successful. Despite the top-air diverter 140 operating to divert precipitation and debris from the first and second upflow ducts 130, 135, some precipitation and debris may nevertheless make its way into the first and second upflow ducts 130, 135. Absent the first and second outlets 150, 155, this precipitation and debris could collect in the first and second upflow ducts 130, 135, impeding the first and second output air streams 170, 175 and the first and second deflected air streams 180, 185. The first and second outlets 150, 155 can operate to clear any precipitation or debris that might collect in the first and second upflow ducts 130, 135, leaving the ducts clear for the passage of the first and second output air streams 170, 175 and the first and second deflected air streams 180, 185.

Figure 2:
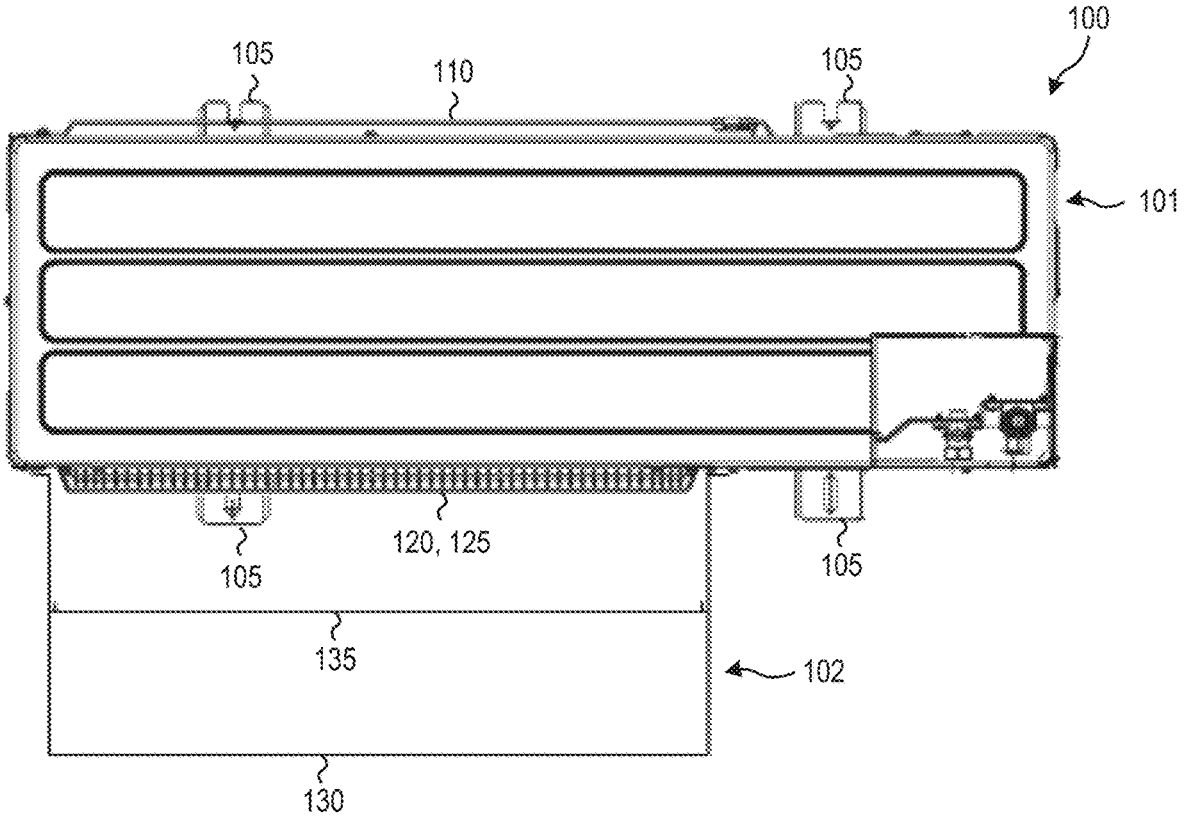
FIG. 2 is a top view of the air-conditioning system of FIG. 1 according to disclosed embodiments.

FIG. 2 is a top view of the air-conditioning system 100 of FIG. 1 according to disclosed embodiments. Specifically, FIG. 2 provides additional information regarding the placement of the plurality of installation feet 105, the first and second fan inputs 110, 115, the first and second fan outputs 120, 125, and the first and second upflow ducts 130, 135.

As shown in FIG. 2, in the disclosed embodiment the first and second upflow ducts 130, 135 are formed such that they surround the first and second fan outputs 120, 125, but do not extend across the entire width of the air conditioner 101.

This is by way of example only, however. Alternate embodiments can vary the size and width of the first and second upflow ducts 130, 135, as desired. The disclosed embodiment uses first and second upflow ducts 130, 135 that cover only the first and second fan outputs 120, 125 in an effort to minimize the size of the air-conditioning system 100 in general and the material required to form the air baffle 102.

Also as shown in FIG. 2, the second upflow duct 135, is formed entirely within the first upflow duct 130. In the disclosed embodiment, the second upflow duct 135 shares a side wall with the first upflow duct 130. However, this is by way of example only. In alternate embodiments, the second upflow duct 135 could have side walls separate from the sidewalls of the first upflow duct 130.

Figure 3:
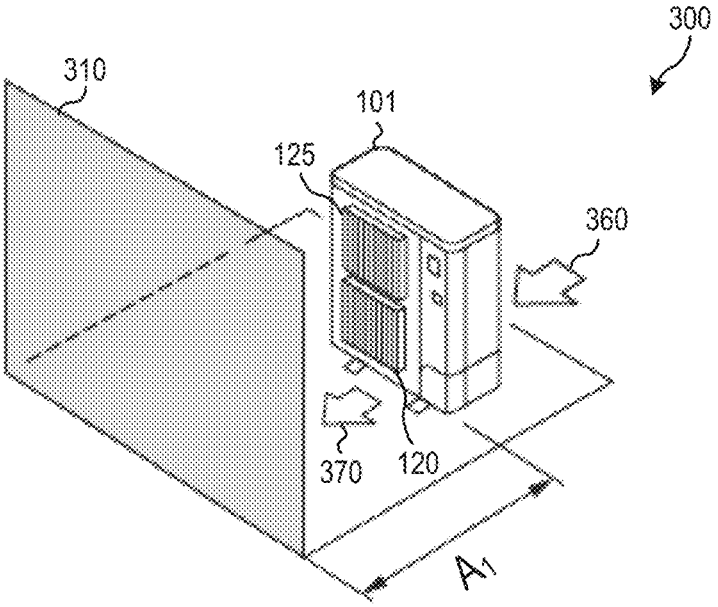
FIG. 3 is a diagram of an air-conditioning system including air conditioner without an air baffle according to disclosed embodiments.

FIG. 3 is a diagram of an air-conditioning system 300 including an air conditioner 101 without an air baffle 102 according to disclosed embodiments. Specifically, the air-conditioning system 300 of FIG. 3 requires that an output side of the air conditioner 101 without an air baffle 102 must be placed a minimum distance $A_1$ from a wall 310 or other obstruction.

As shown in FIG. 3, the air conditioner 101 includes first and second fans, one on top of each other. The first (bottom) fan has a first fan output 120, and the second (top) fan has a second fan output 125. The first and second fan inputs (not shown) receive input air 360, and the first and second fan outputs 120, 125 generate output air streams 370.

In order to allow the first and second fans in the air conditioner 101 to operate properly, a minimum distance $A_1$ must be provided between the first and second fan outputs 120, 125 and any nearby obstruction, such as a wall 310. If the distance $A_1$ is below the minimum required value, the wall 310 (or other interfering structure) will interfere with the output air streams 370 causing the first and second fans in the air conditioner 101 to operate less efficiently.

The minimum distance $A_1$ can vary depending upon the design of the air conditioner 101. However a typical value of $A_1$ would be in the range of 2 to 4 feet. This minimum distance $A_1$ can serve to limit the ability to place air conditioners 101 close to each other when forming an air conditioner array. As a result, a relatively large space can be required for even a single air conditioner 101, much less an array of air conditioners 101.

Figure 4:
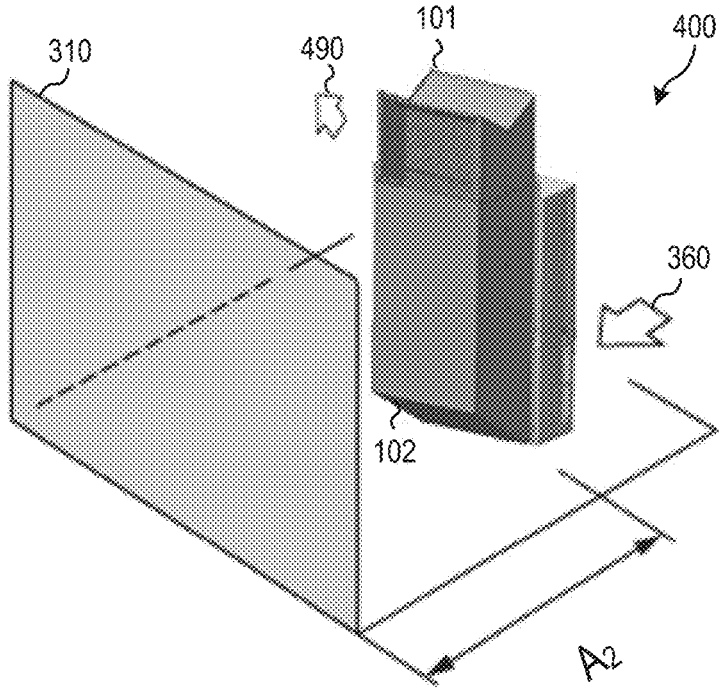
FIG. 4 is a diagram of an air-conditioning system including an air conditioner with an air baffle according to disclosed embodiments.

FIG. 4 is a diagram of an air-conditioning system 400 including an air conditioner 101 with an air baffle 102 according to disclosed embodiments. Specifically, the air-conditioning system 400 of FIG. 4 requires that an output side of the air conditioner 101 with an air baffle 102 must be placed a minimum distance $A_2$ from a wall 310 or other obstruction.

As shown in FIG. 4, and with reference to FIG. 1, the air conditioner 101 includes first and second fans, one on top of each other. The first (bottom) fan has a first fan output (not shown), and the second (top) fan has a second fan output not shown. The first and second fan inputs (not shown) receive input air 360, the first and second fan outputs generate output air streams, the first and second output air streams are deflected by the air baffle 102 to generate first and second deflected air streams, which are in turn diverted by the air baffle 102 to generate angled air streams 490 that flow out of a top-air diverter 140 in the air baffle 102. In this way, the output air from the two fans in the air conditioner 101 are not expelled from the air-conditioning system 400 horizontally from the first and second fan outputs 120, 125 on the side of the air conditioner 101, but are rather output at set angles from vertical at the top of the air baffle 102.

In order to allow the first and second fans in the air conditioner 101 to operate properly, a minimum distance $A_2$ must be provided between the air baffle 102 and any nearby obstruction, such as a wall 310. If the distance $A_2$ is below the minimum required value, the wall 310 (or other interfering structure) will interfere with the angled air streams 490, causing the first and second fans in the air conditioner 101 to operate less efficiently.

However, because the angled air streams 490 are generated at a set angle from vertical, not directly horizontal, and are expelled above the air conditioner 101 in two different directions, the minimum distance $A_2$ that an air conditioner 101 with an air baffle 102 must be from an obstruction such as a wall 301 is much less than the minimum distance $A_1$ that an air conditioner 101 without an air baffle 102 must be from a similar obstruction. In the disclosed embodiments, the distance $A_2$ may be in the range of 6 to 18 inches.

Because the distance $A_2$ is significantly lower than the distance $A_1$, air conditioners 101 with air baffles 102 can be placed much closer to obstructions than air conditioners 101 without air baffles 102. This allows air-conditioning systems 400 that include both an air conditioner 101 and an air baffle 102 to be placed in smaller areas than air-conditioning systems 300 that include only an air conditioner 101 without an error baffle 102

Air Conditioner Array

In some situations, it is desirable to provide an array of air conditioners 101 to support the air-conditioning needs of a building or set of buildings. For example, an apartment building with multiple apartments might require a plurality of air conditioners 101 to properly serve the needs of all of its tenants.

As shown in FIGS. 3 and 4, it is necessary to provide a certain clearance ($A_1$ or $A_2$) between the air output of an air-conditioning system 100, 300, 400 and any interfering element, such as a wall or another air-conditioning system 100, 300, 400. Furthermore, the distance $A_2$ required between an air-conditioning system 100, 400 that includes both an air conditioner 101 and an air baffle 102 is smaller than the distance $A_1$ required between an air-conditioning system 300 that includes only an air conditioner 101 and not an air baffle 102.

There will be similar, though smaller, clearances required between the fan inputs 110, 115 and any obstruction, as well as between any sides of an air conditioner 101 that do not contain the fan inputs 110, 115 or the fan outputs 120, 125 and any obstruction.

In addition, clearance requirements for air-conditioning systems 300 that include only an air conditioner 101 and not an air baffle 102 can be even greater when the air conditioners 101 are arranged in a row such that the fan outputs 120, 125 of a first air conditioner 101 face the fan inputs 110, 115 of a second air conditioner.

An air conditioner 101 generally functions by transferring heat between a refrigerant and supply air drawn in by one or more fans. The effectiveness of the air conditioner 101 depends upon the temperature difference is between the supply air and the desired temperature of an inside space whose air is being conditioned.

When the air conditioner 101 is performing a cooling operation, it is desirable that the supply air be as cool as possible. The warmer the supply air is, the less effective the air conditioner 101 will be in performing its cooling operation. Similarly, when the air conditioner 101 is performing a heating operation, it is desirable that the supply air be as warm as possible. The cooler the supply air is, the less effective the air conditioner 101 will be in performing its heating operation.

This presents a problem when two air conditioners 101 without air baffles 102 are arranged in a row with the fan output 120, 125 of a first air conditioner 101 facing the fan input 110, 115 of a second air conditioner. This is because the output air from an air conditioner 101 is of a different temperature than the input air 160, 165 (warmer in the case of a cooling operation, and cooler in the case of a warning operation). As a result, in this situation where the air conditioners 101 are too close to each other, the input air 160, 165 of the second air conditioner will be at a disadvantageous temperature for ideal or efficient operation. If the air conditioners 101 are performing cooling operations, the input air 160, 165 of the second air conditioner will be too warm; and if the air conditioners 101 are performing a heating operation, the input air 160, 165 of the second air conditioner will be too cold.

Because of this, the required distance (clearance) between the fan outputs 120, 125 of one air conditioner 101 and the fan inputs 110, 115 of another air conditioner is typically greater than the required distance $A_1$ between the fan output 120, 125 of an air conditioner and a generic interfering structure. For example, in some cases the required distance between the fan outputs 120, 125 of one air conditioner 101 and the fan inputs 110, 115 of another air conditioner can be in the range of 10 feet. This can make it extremely disadvantageous to arrange air conditioners 101 in an array (i.e., a line) with each air conditioner having the same orientation. In many situations, it makes such an air conditioner array impractical.

However, there are reasons why arranging air conditioners 101 in an array with each air conditioner having the same orientation would be advantageous. For example, assuming each air conditioner 101 in the array was of the same design, each would have its power and refrigerant connectors on the same side of the air conditioner 101. If the air conditioners 101 were arranged in an array with all of the air conditioners 101 facing in the same direction, then the power and refrigerant connectors would all be on the same side of the air conditioner array. This would make it simpler and cheaper to run power and refrigerant connections to the various air conditioners 101.

One of the further advantages of an air-conditioning system 100 including an air conditioner 101 and an air baffle 102 is that the clearance $A_2$ required between an air conditioner 101/air baffle 102 and an interfering structure 310 does not change when the interfering structure is the input of another air-conditioning system 100. As a result, it is possible to arrange air-conditioning systems 100 relatively close to each other as compared to air-conditioning systems 300 without air baffles 102, even if they are all in the same orientation. This can allow for a much larger number of air-conditioning systems 100 to be placed in a given area as compared to air-conditioning systems 300 without air baffles 102, and can allow for advantageous power and/or refrigerant connections.

Figure 5:
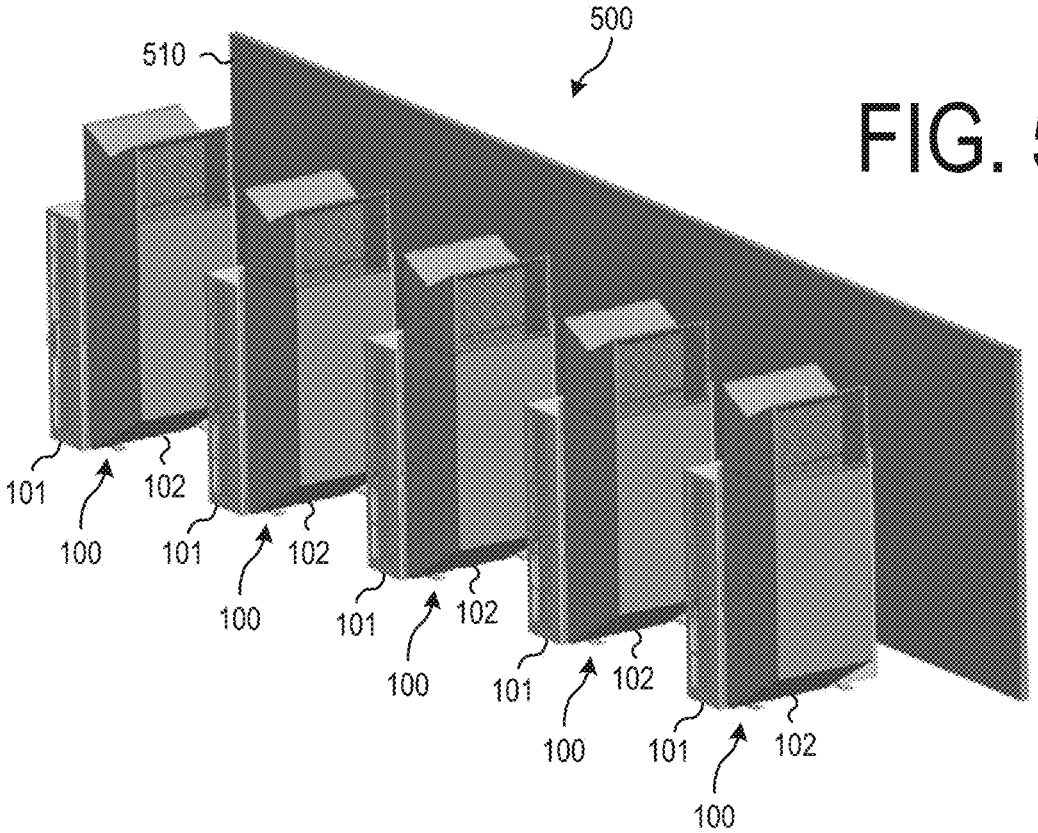
FIG. 5 is a diagram of an air conditioner array according to disclosed embodiments.

FIG. 5 is a diagram of an air conditioner array 500 according to disclosed embodiments. As shown in FIG. 5, the air conditioner array 500 includes a plurality of air-conditioning systems 100, each including an air conditioner 101 and air baffle 102. The air-conditioning systems 100 are arranged in a line in the same orientation, with the fan inputs 110, 115 of all of the air conditioners 101 facing the same first direction, and the fan outputs 120, 125 of all of the air conditioners 101 also facing the same second direction. In this embodiment, the air conditioner array 500 is also arranged next to a wall 510.

Because of the presence of the air baffles 102 in each of the air-conditioning systems 100, the air-conditioning systems 100 can be placed relatively close to each other (e.g., approximately a foot away from each other). Furthermore, by having the sides of the air conditioners 101 (i.e., not the fan inputs 110, 115 or the fan outputs 120, 125) facing the wall 510, the array of air-conditioning systems 100 be placed extremely close to the wall 510. This combination of small clearances allows the air-conditioner array 500 to be placed in an extremely small area as compared to air-conditioning systems 300 without air baffles 102.

Furthermore, by arranging the air conditioners 101 in the same orientation, the power and refrigerant connections for the air conditioners 101 will be on the same side for every air-conditioner 101 in the array 500, allowing for easier and cheaper power and refrigerant connections.

Figure 6:
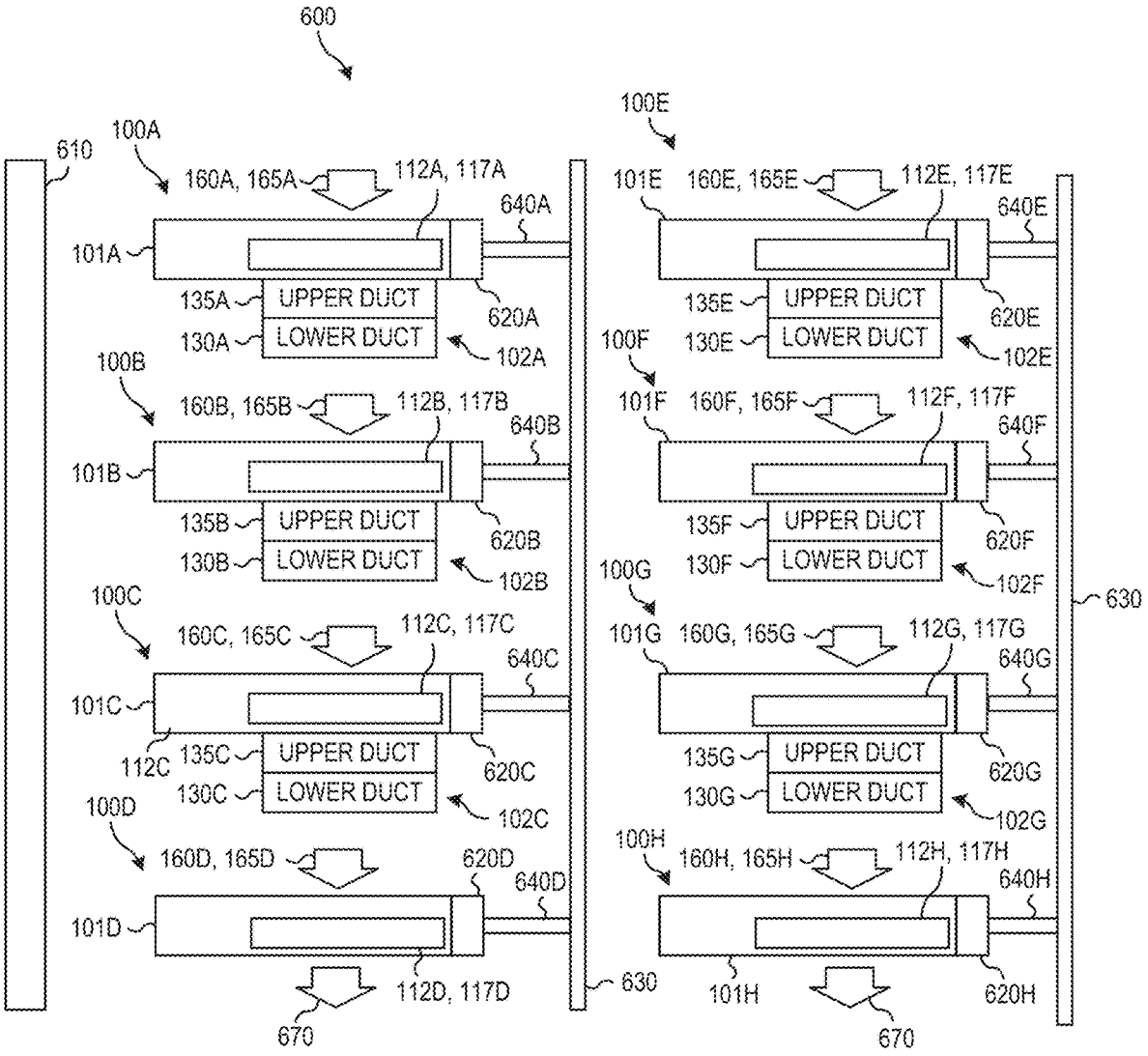
FIG. 6 is a block diagram of an air conditioner array according to disclosed embodiments.

FIG. 6 is a block diagram of an air conditioner array 600 according to disclosed embodiments. As shown in FIG. 6, the air-conditioner array 600 includes a plurality of air-conditioning systems 100 arranged in a 2×4 array. Thus, the air-conditioner array 600 in the exemplary embodiment of FIG. 6 includes eight air-conditioning systems 100A-100H. Each air-conditioning system 100 includes an air conditioner 101 and an air baffle 102. Each air conditioner 101 has two fans 112, 117, receives input air 160, 165 at a first side, has the air baffle 102 connected on a second side opposite the first side, and has a power/refrigerant connector 620 on a third side different from the first and second sides. (Since FIG. 6 illustrates a top view of the air conditioner array 600, the fan 117 overlaps the fan 112 so they are represented by a single box.) Each air baffle 102 includes a first upload duct 130 and a second upload duct 135. Each air-conditioning system 100 is oriented in the same direction such that all of the first sides face a first direction, all of the second sides face a second direction opposite the first direction, and all of the third sides face a third direction different from the first and second directions. The air-conditioner array includes a plurality of power/refrigerant lines 630, with each power/refrigerant line 630 having a plurality of power/refrigerant sub-lines 640 connecting the power/refrigerant line 630 to a respective power/refrigerant connector 620. The array 600 includes two parallel lines of four air-conditioning systems 100. One of the lines of four air-conditioning systems 100 is arranged adjacent to a wall 610.

A first air-conditioning system 100A includes a first air conditioner 101A and a first air baffle 102A. The first air conditioner 101A includes first and second fans 112A, 117A, receives first input air 160A, 165A at a first side, has the first air baffle 102A connected on a second side opposite the first side, and has the first power/refrigerant connector 620A on a third side different from the first and second sides. The first air baffle 102A includes a first upload duct 130A and a second upload duct 135A.

A second air-conditioning system 100B includes a second air conditioner 101B and a second air baffle 102B. The second air conditioner 101B includes third and fourth fans 112B, 117B, receives second input air 160B, 165B at a first side, has the second air baffle 102B connected on a second side opposite the first side, and has the second power/refrigerant connector 620B on a third side different from the first and second sides. The second air baffle 102B includes a third upload duct 130B and a fourth upload duct 135B.

A third air-conditioning system 100C includes a third air conditioner 101C and a third air baffle 102C. The third air conditioner 101C includes fifth and sixth fans 112C, 117C, receives third input air 160C, 165C at a first side, has the third air baffle 102C connected on a second side opposite the first side, and has the third power/refrigerant connector 620C on a third side different from the first and second sides. The third air baffle 102C includes a fifth upload duct 130C and a sixth upload duct 135C.

A fourth air-conditioning system 100D includes a fourth air conditioner 101D and a fourth air baffle 102D. The fourth air conditioner 101D includes seventh and eighth fans 112D, 117D, receives fourth input air 160D, 165D at a first side, has the fourth air baffle 102D connected on a second side opposite the first side, and has the fourth power/refrigerant connector 620D on a third side different from the first and second sides. The fourth air baffle 102D includes a seventh upload duct 130D and an eighth upload duct 135D.

A fifth air-conditioning system 100E includes a fifth air conditioner 101E and a fifth air baffle 102E. The fifth air conditioner 101E includes ninth and tenth fans 112E, 117E, receives fifth input air 160E, 165E at a first side, has the fifth air baffle 102E connected on a second side opposite the first side, and has the fifth power/refrigerant connector 620E on a third side different from the first and second sides. The fifth air baffle 102E includes a ninth upload duct 130E and a tenth upload duct 135E.

A sixth air-conditioning system 100F includes a sixth air conditioner 101F and a sixth air baffle 102F. The sixth air conditioner 101F includes eleventh and twelfth fans 112F, 117F, receives sixth input air 160F, 165F at a first side, has the sixth air baffle 102F connected on a second side opposite the first side, and has the sixth power/refrigerant connector 620F on a third side different from the first and second sides. The sixth air baffle 102F includes an eleventh upload duct 130F and a twelfth upload duct 135F.

A seventh air-conditioning system 100G includes a seventh air conditioner 101G and a seventh air baffle 102G. The seventh air conditioner 101G includes thirteenth and fourteenth fans 112G, 117G, receives seventh input air 160G, 165G at a first side, has the seventh air baffle 102G connected on a second side opposite the first side, and has the seventh power/refrigerant connector 620G on a third side different from the first and second sides. The seventh air baffle 102G includes a thirteenth upload duct 130G and a fourteenth upload duct 135G.

An eighth air-conditioning system 100H includes an eighth air conditioner 101H and an eighth air baffle 102H. The eighth air conditioner 101H includes fifteenth and sixteenth fans 112H, 117H, receives eighth input air 160H, 165H at a first side, has the eighth air baffle 102H connected on a second side opposite the first side, and has the eighth power/refrigerant connector 620H on a third side different from the first and second sides. The eighth air baffle 102H includes a fifteenth upload duct 130H and a sixteenth upload duct 135H.

Elements that are the same as those described above with respect to FIG. 1 perform the same functions and their description will not be repeated.

The wall 610 is an interfering structure located adjacent to one line of air-conditioning systems 100 in the air-conditioning array 600. Although in this embodiment a wall 610 is disclosed, the wall 610 could be replaced with any similar interfering structure (e.g., shrubs, etc.), or could be eliminated entirely.

As noted above, because the wall 610 is adjacent to a side of the air conditioners 101 that is not a fan input side or a fan output side, the array can be placed relatively close to the wall 610.

Similarly, because the two rows of air-conditioning systems 100 have sides facing each other that are neither fan input sides nor fan output sides, the two rows of air-conditioning systems 100 can be placed relatively close to each other.

As result of the short clearance between both the wall 610 and the first line of air-conditioning systems 100, and the short clearance between the first line of air-conditioning systems 100 and the second line of air-conditioning systems 100, the entire array 600 can be placed in an extremely small area as compared to an array of air-conditioning systems that do not include air baffles 102.

The power/refrigerant connectors 620 represent the portions of the air conditioners 101 that receive either power or refrigerant. Typically, they are located on the same side of each air conditioner 101, such that when the air conditioners are arranged in an array all facing the same direction, the power/refrigerant connectors 620 will all be located on the same side of the array of air-conditioning systems 100. In various embodiments, the power/refrigerant connectors 620 can be only power connectors, only refrigerant connectors, or a combination of power and refrigerant connectors.

Although the power/refrigerant connectors 620 are disclosed as being on a side different from the side containing the fan inputs 110, 115 and the side containing the fan outputs 120, 125, this is by way of example only. In alternate embodiments the power/refrigerant connectors 620 can be formed on any side of the air conditioner 101.

The power/refrigerant lines 630 represent refrigerant pipes or power wires that provide either or both of power and refrigerant to the air conditioners 101. The refrigerant pipes can connect to an indoor air-conditioning unit that uses the refrigerant to heat or cool an indoor space. The refrigerant can be sent to the air conditioners 101 to exchange heat with supply air received as input air 160, 165. The power pipes can connect to an external power source, such as a generator or municipal power. In various embodiments, the power/refrigerant lines 630 can be only power wires, only refrigerant pipes, or a combination of power wires and refrigerant pipes.

The power/refrigerant sub-lines 640 represent wires or pipes that connect the power/refrigerant lines 630 to the power/refrigerant connectors 620 on each air conditioner 101. In various embodiments, the power/refrigerant sub-lines 640 can be only power wires, only refrigerant pipes, or a combination of power wires and refrigerant pipes.

As noted above, because the air-conditioning systems 100 in the array 600 are all oriented in the same direction, all of the power/refrigerant connectors 620 are located on the same side of the array 600 of air conditioning systems. A single power/refrigerant line 630 can then be run past each line of air conditioning systems 100 in the array 600. Since each power/refrigerant connector 620 is located on the same side of each air-conditioning system 100, this single power/refrigerant line 630 can be run close to each power/refrigerant connector 620. As a result, the power/refrigerant sub-line 640 can be relatively short, thus minimizing cost and complexity when running the power/refrigerant sub-lines 640.

Absent the air baffles 102, it would typically be impractical to arrange the air-conditioning systems 100 in a line, with each air-conditioning system 100 having the same orientation. Such an arrangement would require distances between each air-conditioning system 100 to be so large as to make the arrangement impractical for many situations.

Furthermore, although a 2×4 air-conditioning array 600 is disclosed in FIG. 6, this is by way of example only. Alternate embodiments can use larger or smaller arrays of air-conditioning systems 100 in different configurations as needed.

Alternate Embodiments

Figure 7:
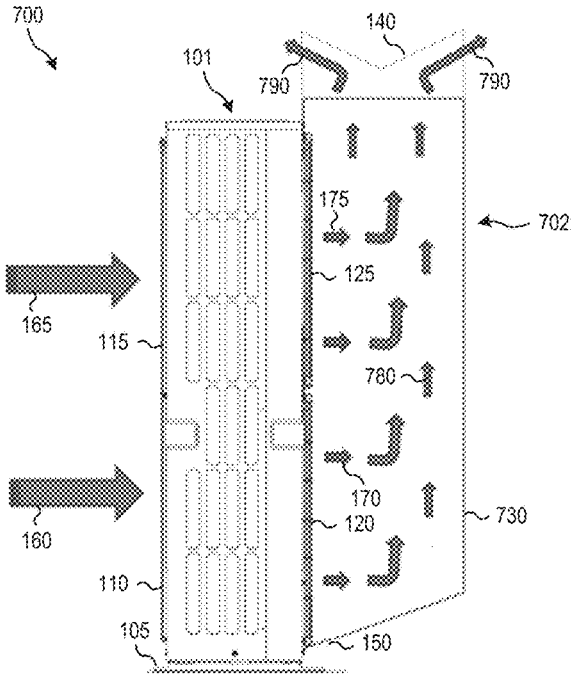
FIG. 7 is a cross-sectional view of an air-conditioning system according to alternate disclosed embodiments.

FIG. 7 is a cross-sectional view of an air-conditioning system 700 according to alternate disclosed embodiments.

Elements that are the same as those described above with respect to FIG. 1 perform the same functions and their description will not be repeated.

The embodiment of FIG. 7 is similar to the embodiment of FIG. 1 except that an air baffle 702 includes only a single upflow duct 730. First and second output air streams 170, 175 from the first and second fan outputs 120, 125, respectively pass into the single upflow duct 730, where they are deflected into a combined air stream 780 passing in a substantially vertical direction.

Figure 8:
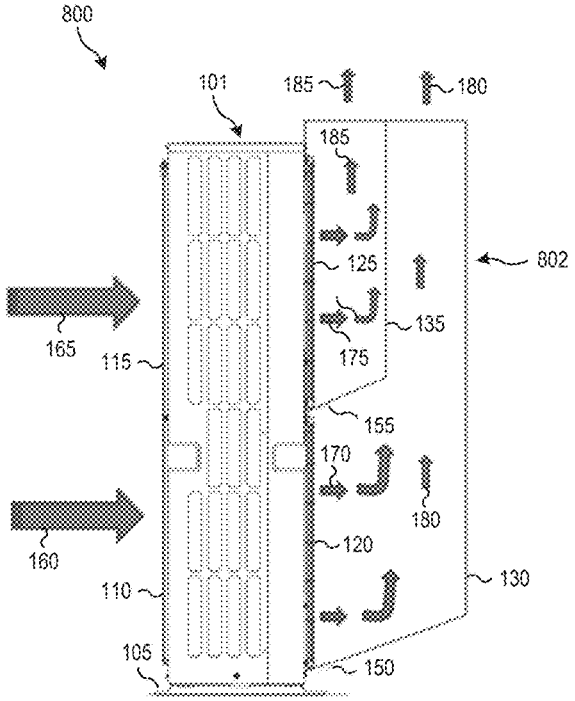
FIG. 8 is a cross-sectional view of an air-conditioning system according to still other alternate disclosed embodiments.

FIG. 8 is a cross-sectional view of an air-conditioning system 800 according to still other alternate disclosed embodiments.

Elements that are the same as those described above with respect to FIG. 1 perform the same functions and their description will not be repeated.

The embodiment of FIG. 8 is similar to the embodiment of FIG. 1 except that an air baffle 802 does not include a top-air diverter 140. First and second output air streams 170, 175 from the first and second fan outputs 120, 125 are diverted into first and second diverted air streams 180, 185 passing in a substantially vertical direction, and these first and second diverted air streams 180, 185 exit directly from the top of the first and second upflow ducts 130, 135.

The embodiments in FIGS. 7 and 8 are merely by way of example. Other alterations can be made to the air-conditioning system design. For example, an outlet 150 for precipitation and debris can be formed in the single upflow duct 130 of the air-conditioning system 700 of FIG. 7, or the top-air diverter 140 can be omitted from the air-conditioning system 700 of FIG. 7.

Likewise, first and second outlets 150, 155 can the omitted from the first and second upflow ducts 130, 135 in the air-conditioning system 800 of FIG. 8, or a top-air diverter 140 can be added to the air-conditioning system 800 of FIG. 8.

Furthermore, although the air-conditioning systems 700, 800 of FIGS. 7 and 8 discloses upflow ducts 130, 135, 730 that are substantially vertical, alternate embodiments can have the upflow ducts 130, 135, 730 angled between 0° and 45° from vertical.

Method of Operation

Figure 9:
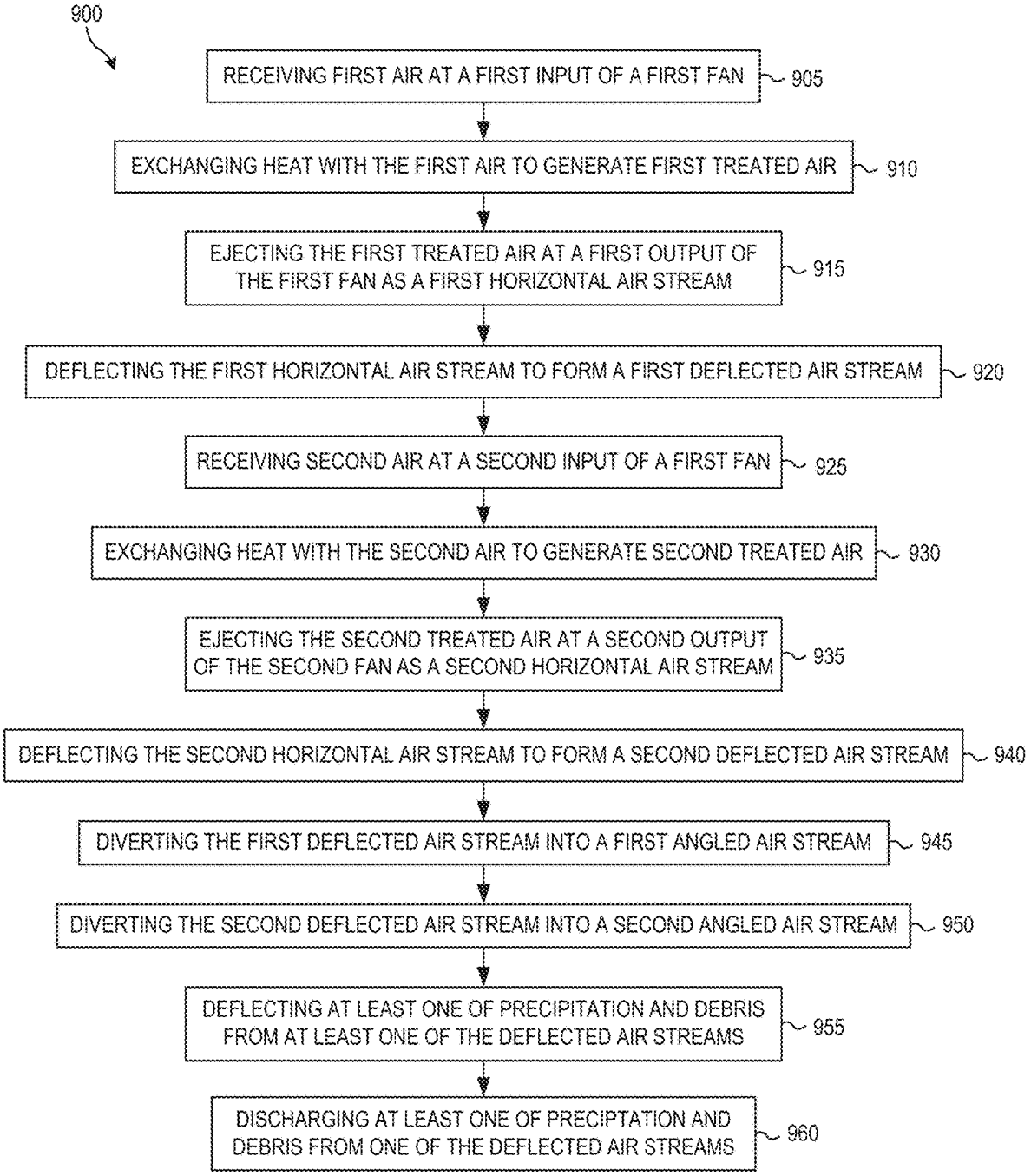
FIG. 9 is a flow chart of a method of operating an air conditioner according to disclosed embodiments.

FIG. 9 is a flow chart of a method of operating an air conditioner according to disclosed embodiments.

As shown in FIG. 9, operation begins by receiving first air 160 at a first input 110 of a first fan in the air conditioner 101 (905). This first air 160 is drawn from supply air, which is typically air at an ambient temperature surrounding an air conditioner 101.

Heat is then exchanged with the first air 160 to generate first treated air (910). This exchange of heat is typically performed between the first air 160 and refrigerant supplied to an air conditioner by a refrigerant pipe from an indoor air-conditioning unit.

The first treated air is then ejected at a first output 120 of the first fan as a first horizontal air stream 170 (915). The horizontal direction is with respect to a surface on which the air conditioner 101 is resting or secured to. Thus, if the air conditioner 101 were secured to a slanting surface, the "horizontal" direction would have a similar slant.

The first horizontal air stream 170 is then deflected to form a first deflected air stream 180 (920). This first deflected air stream 180 will be deflected to pass in a direction between 0° and 45° from a vertical direction. This vertical direction is with respect to a surface on which the air conditioner 101 is resting or secured to. Thus, if the air conditioner 101 were secured to a slanting surface the "vertical" direction would have a similar slant.

Typically, the best results are obtained by having the first deflected air stream 180 be vertical or substantially vertical. However, in some embodiments it may be desirable to provide the first deflected air stream 180 with a slight slant.

Operation continues by receiving second air 165 at a second input 115 of a second fan in the air conditioner 101 (925). This second air 165 is drawn from supply air, which is typically air at an ambient temperature surrounding an air conditioner 101.

Heat is then exchanged with the second air 165 to generate second treated air (930). This exchange of heat is typically performed between the second air 165 and refrigerant supplied to an air conditioner by a refrigerant pipe.

The second treated air is then ejected at a second output 125 of the first fan as a second horizontal air stream 175 (935). The horizontal direction is with respect to a surface on which the air conditioner 101 is resting or secured to. Thus, if the air conditioner 101 were secured to a slanting surface, the "horizontal" direction would have a similar slant.

The second horizontal air stream 175 is then deflected to form a second deflected air stream 185 (940). This second deflected air stream 185 will be deflected to pass in a direction between 0° and 45° from a vertical direction. This vertical direction is with respect to a surface on which the air conditioner 101 is resting or secured to. Thus, if the air conditioner 101 were secured to a slanting surface the "vertical" direction would have a similar slant.

Typically, the best results are obtained by having the second deflected air stream 185 be vertical or substantially vertical. However, in some embodiments it may be desirable to provide the second deflected air stream 185 with a slight slant.

Although both the first and second horizontal air streams 170, 175 are deflected to form first and second deflected air streams 180, 185, these first and second deflected air streams 180, 185 do not need to flow in the same direction. In other words, the angle between vertical for each of these deflected air streams 180, 185 could be different in various embodiments. For example, the first deflected air stream might be at an angle of 5° from vertical, while the second deflected air stream might be at an angle of 0° from vertical. Many other combinations are possible, based on system requirements.

The first deflected air stream 180 is then diverted into a first angled air stream 190 (945). This is generally performed to accommodate a top-air diverter 140 used to limit precipitation and debris from passing into the first deflected air stream 180. As a result, this operation may be omitted in embodiments in which a top-air diverter 140 is not used.

The second deflected air stream 185 is then diverted into a second angled air stream 195 (950). This is generally performed to accommodate a top-air diverter 140 used to limit precipitation and debris from passing into the second deflected air stream 185. As a result, this operation may be omitted in embodiments in which a top-air diverter 140 is not used.

At least one of precipitation and debris is then deflected from at least one of the first and second deflected air streams 180, 185 (955). This operation does not have to be performed, and may be omitted in some embodiments.

The operation of deflecting precipitation and debris (955) is generally not a perfect operation. As a result, some precipitation and debris may find its way into one or both of the first and second deflected air streams 180, 185. Therefore, at least one of precipitation and debris will then be discharged from one or both of the first and second deflected air streams 180, 185 (960). This operation does not have to be performed, and may be omitted in some embodiments.

Although FIG. 9 discloses receiving first air (905), exchanging heat with the first air (910), ejecting first treated air (915), and deflecting the first horizontal air stream (920) prior to receiving second air (925), exchanging heat with the second air (930), ejecting second treated air (935), and deflecting the second horizontal air stream (940), this is by way of example only. In fact, these two sets of operations can be performed in any order, and in fact will often be performed continually and in parallel.

Similarly, although the operation of diverting the first deflected air stream (945) is shown as being performed before diverting the second deflected air stream (950) this is also by way of example only. These two operations can be performed in any order, and will often be performed continually and in parallel.

Likewise, the operations of deflecting at least one of precipitation and debris (955) and discharging at least one of precipitation and debris (960) can be performed at any part of the operation, and in fact will often be continually performed throughout operation.

CONCLUSION

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

What is claimed:

1. An air-conditioning system, comprising:

an air conditioner including a first fan having a first fan input on a first side of the air-conditioner configured to receive first input air, and a first fan output on a second side of the air-conditioner configured to generate a first output air stream in a horizontal direction with respect to a surface on which the air conditioner is placed, and a second fan having a second fan input on the first side of the air-conditioner configured to receive second input air, and a second fan output on the second side of the air-conditioner configured to generate a second output air stream in the horizontal direction;

an air baffle including a first upflow duct attached to the second side of the air conditioner and configured to direct the first output air stream into a first deflected air stream flowing in a first direction between 0 degrees and 45 degrees from vertical with respect to the surface, and a second upflow duct attached to the second side of the air conditioner and configured to direct the second output air stream into a second deflected air stream flowing in a second direction between 0 degrees and 45 degrees from vertical with respect to the surface.

2. The air-conditioning system of claim 1, wherein the first airflow duct and the second air flow duct are configured such that the first deflected air stream and the second deflected air stream have substantially the same air flow.

3. The air-conditioning system of claim 1, wherein the air conditioner is a heat pump.

4. The air-conditioning system of claim 1, wherein the second fan is located above the first fan.

5. The air-conditioning system of claim 4, wherein the second duct is located inside the first duct.

6. The air-conditioning system of claim 1, wherein the air baffle further comprises a top-air diverter located above the first and second upflow ducts, and the top-air diverter is configured to divert the first deflected air stream into a first angled air stream that flows at a first set angle from vertical, divert the second deflected air stream into a second angled air stream that flows at a second set angle from vertical, and limit at least one of precipitation and debris from passing into the first and second upflow ducts.

7. The air-conditioning system of claim 6, wherein the first angled air stream and the second angled air stream flow in different directions.

8. The air-conditioning system of claim 6, wherein the first and second set angles are both between 30 and 60 degrees.

9. The air-conditioning system of claim 1, wherein wherein the first upflow duct further comprises a first outlet on a first bottom portion, the first outlet being configured to provide an outlet for at least one of precipitation and debris that passes into the first upflow duct.

10. The air-conditioning system of claim 9, wherein wherein the second upflow duct further comprises a second outlet on a second bottom portion, the second outlet being configured to provide an outlet for at least one of precipitation and debris that passes into the second upflow duct.

11. The air-conditioning system of claim 1, wherein the first and second deflected air streams are substantially vertical with respect to the surface.

12. An air-conditioning array comprising:

a plurality of the air-conditioning systems as recited in claim 1, wherein the plurality of air-conditioning systems are arranged in a row along a direction of the first and second horizontal air streams such that the first side of each of the plurality of air-conditioning systems faces the same direction.

13. A method of operating an air-conditioning system, comprising:

receiving first air at a first input of a first fan on a first side of an air conditioner;

ejecting the first air at a first output of the first fan on a second side of the air conditioner as a first horizontal air stream flowing horizontal to a surface on which the air-conditioning system is placed;

deflecting the first horizontal air stream to form a first deflected air stream flowing in a first direction between 0 degrees and 45 degrees from vertical with respect to the surface;

receiving second air at a second input of a second fan on the first side of the air conditioner;

ejecting the second air at a second output of the second fan on the second side of the air conditioner as a second horizontal air stream flowing horizontal to the surface;

deflecting the second horizontal air stream to form a second deflected air stream flowing in a second direction between 0 degrees and 45 degrees from vertical with respect to the surface;

wherein the first deflected air stream and the second deflected air stream are isolated from each other.

14. The method of claim 13, further comprising diverting the first deflected air stream into a first angled air stream that flows at a first set angle from vertical with respect to the surface, diverting the second deflected air stream into a second angled air stream that flows at a second set angle from vertical with respect to the surface, and deflecting at least one of precipitation and debris from passing into the first and second deflected air streams.

15. The method of claim 13, further comprising:

discharging at least one of precipitation and debris from interfering with either the first horizontal air flow or the first deflected air flow.

16. The method of claim 15, wherein discharging at least one of precipitation and debris from interfering with either the second horizontal air flow or the second deflected air flow.

17. An air-conditioning array comprising:

a first air conditioner including a first fan configured to draw in first air from a first input surface of the first air conditioner and to generate a first horizontal air stream at a first output surface of the first air conditioner opposite the first input surface, a second fan configured to draw in second air from the first input surface and to generate a second horizontal air stream from the first output surface, a first air baffle affixed to the first output surface and configured to deflect the first horizontal air stream to generate a first deflected air stream flowing in a first direction between 0 degrees and 45 degrees from vertical and to deflect the second horizontal air stream to generate a second deflected air stream flowing in a second direction between 0 degrees and 45 degrees from vertical;

a second air conditioner including a third fan configured to draw in third air from a second input surface of the second air conditioner and to generate a third horizontal air stream at a second output surface of the second air conditioner opposite the second input surface, a fourth fan configured to draw in fourth air from the second input surface and to generate a fourth horizontal air stream from the second output surface, a second air baffle affixed to the second output surface and configured to deflect the third horizontal air stream to generate a third deflected air stream flowing in a third direction between 0 degrees and 45 degrees from vertical and to deflect the fourth horizontal air stream to generate a fourth deflected air stream flowing in a fourth direction between 0 degrees and 45 degrees from vertical, wherein the first output surface is arranged to face the second input surface, and a distance between the first and second air conditioners is set to be less than 36 inches.

18. The air-conditioning array of claim 17, further comprising:

a third air conditioner including a fifth fan configured to draw in fifth air from a third input surface of the third air conditioner and to generate a fifth horizontal air stream at a third output surface of the third air conditioner opposite the third input surface, a sixth fan configured to draw in sixth air from the third input surface and to generate a sixth horizontal air stream from the third output surface, a third air baffle affixed to the third output surface and configured to deflect the fifth horizontal air stream to generate a fifth deflected air stream flowing in a fifth direction between 0 degrees and 45 degrees from vertical and to deflect the sixth horizontal air stream to generate a sixth deflected air stream flowing in a sixth direction between 0 degrees and 45 degrees from vertical, wherein the second output surface is arranged to face the third input surface, and a distance between the second and third air conditioners is set to be less than 36 inches.

19. The air-conditioning array of claim 17, further comprising:

a refrigerant pipe configured to carry a refrigerant, wherein the first air conditioner includes a first refrigerant connector on a first side surface, the second air conditioner includes a second refrigerant connector on a second side surface, the first and second side surfaces face in the same direction, the refrigerant pipe passes beside the first and second side surfaces, the refrigerant pipe is connected to the first refrigerant connector, and the refrigerant pipe is connected to the second refrigerant connector.

20. The air-conditioning array of claim 17, further comprising:

a power line configured to carry electric power, wherein the first air conditioner includes a first power connector on a first side surface, the second air conditioner includes a second power connector on a second side surface, the first and second side surfaces face in the same direction, the power line passes beside the first and second side surfaces, the power line is connected to the first power connector, and the power line is connected to the second power connector.

* * * * *